US011248450B2

(12) United States Patent
Hazelip

(10) Patent No.: US 11,248,450 B2
(45) **Date of Patent: *Feb. 15, 2022**

(54) LINER HANGER WITH HARDENED ANCHORING RIDGES

(71) Applicant: Halliburton Energy Services, Inc., Houston, TX (US)

(72) Inventor: Gary Lynn Hazelip, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 26 days.

This patent is subject to a terminal disclaimer.

(21) Appl. No.: 16/485,402

(22) PCT Filed: Aug. 14, 2018

(86) PCT No.: PCT/US2018/046702
§ 371 (c)(1),
(2) Date: Aug. 12, 2019

(87) PCT Pub. No.: WO2020/036592
PCT Pub. Date: Feb. 20, 2020

(65) Prior Publication Data

US 2020/0370383 A1 Nov. 26, 2020

(51) Int. Cl.
*E21B 43/10* (2006.01)
*E21B 23/01* (2006.01)
(Continued)

(52) U.S. Cl.
CPC ..... *E21B 43/103* (2013.01); *E21B 23/01* (2013.01); *E21B 33/10* (2013.01); *E21B 43/105* (2013.01); *E21B 23/06* (2013.01)

(58) Field of Classification Search
CPC ..... E21B 23/01; E21B 23/06; E21B 43/103; E21B 43/105
See application file for complete search history.

(56) References Cited

U.S. PATENT DOCUMENTS 4,663,513 A * 5/1987 Webber ..... B23K 26/034 219/121.6
4,832,125 A * 5/1989 Taylor ..... E21B 33/043 166/348

(Continued)

OTHER PUBLICATIONS

ISRWO International Search Report and Written Opinion for PCT/US2018/046702 dated Aug. 14, 2018.

(Continued)

*Primary Examiner* — D. Andrews
(74) *Attorney, Agent, or Firm* — Scott Richardson; C. Tumey Law Group PLLC

(57) ABSTRACT

A method and device for a radially expandable downhole tool for bearing axial loads upon radial expansion into anchoring and sealing engagement with a downhole tubular positioned in a subterranean wellbore. The device may comprise a radially expandable tubular defining an interior passageway and an exterior surface. The device may further comprise an axial load bearing assembly positioned on the exterior surface of the expandable tubular and having an anchoring sub-assembly for engaging the downhole tubular and bearing axial loads placed on the downhole tool, the anchoring sub-assembly having a plurality of radially extending ridges, each ridge having a hardened anchoring surface and corners, for penetrating into the downhole tubular and a plurality of longitudinally extending milled grooves formed in each ridge, and a sealing sub-assembly for, after the radial expansion, engaging the downhole tubular and sealing the annulus defined between the downhole tubular and the radially expandable downhole tool.

20 Claims, 5 Drawing Sheets

(51) Int. Cl.
*E21B 33/10* (2006.01)
*E21B 23/06* (2006.01)

(56) References Cited

U.S. PATENT DOCUMENTS

| | | | | |
|---|---|---|---|---|
| 7,360,592 | B2 * | 4/2008 | McMahan | E21B 23/01 166/207 |
| 9,752,400 | B2 * | 9/2017 | Hazelip | E21B 43/108 |
| 2003/0047322 | A1 | 3/2003 | Maguire et al. | |
| 2006/0237188 | A1 | 10/2006 | McMahan | |
| 2014/0020911 | A1 * | 1/2014 | Martinez | E21B 23/01 166/387 |
| 2016/0032671 | A1 | 2/2016 | Xu et al. | |
| 2016/0053591 | A1 | 2/2016 | Hallundbaek et al. | |
| 2016/0090801 | A1 | 3/2016 | Hazelip et al. | |
| 2018/0045016 | A1 * | 2/2018 | Radtke | E21B 33/1208 |

OTHER PUBLICATIONS

Michael J. Schneider, et al., Introduction to Surface Hardening of Steels, ASM Handbook, vol. 4A, 2013.

* cited by examiner

LINER HANGER WITH HARDENED ANCHORING RIDGES

BACKGROUND

During wellbore operations, it is typical to "hang" a liner onto a casing such that the liner supports an extended string of tubular below it. As used herein, "tubing string" refers to a series of connected pipe sections, casing sections, joints, screens, blanks, cross-over tools, downhole tools and the like, inserted into a wellbore, whether used for drilling, work-over, production, injection, completion, or other processes. A tubing string may be run in and out of the casing, and similarly, tubing string can be run in an uncased wellbore or section of wellbore. Further, in many cases a tool may be run on a wireline or coiled tubing instead of a tubing string, as those of skill in the art will recognize.

Expandable liner hangers may generally be used to secure the liner within a previously set casing or liner string. Expandable liner hangers may be "set" by expanding the liner hanger radially outward into gripping and sealing contact with the casing or liner string. For example, expandable liner hangers may be expanded by use of hydraulic pressure to drive an expanding cone, wedge, or "pig," through the liner hanger. Other methods may be used, such as mechanical swaging, explosive expansion, memory metal expansion, swellable material expansion, electromagnetic force-driven expansion, etc.

The expansion process may typically be performed by means of a setting tool used to convey the liner hanger into the wellbore. The setting tool may be interconnected between a work string (e.g., a tubular string made up of drill pipe or other segmented or continuous tubular elements) and the liner hanger. The setting tool may expand the liner hanger into anchoring and sealing engagement with the casing.

As can be appreciated, the expanded liner hanger should support the substantial weight of the attached tubing string below. For deep and extra-deep wells, subsea wells, etc., the tubing string places substantial axial load on the hanging mechanism engaging the liner hanger to the casing. There is a need for improved methods and apparatus providing an expandable liner hanger having an anchoring mechanism and sealing mechanism capable of supporting the substantial axial loads imparted by longer and heavier liner strings. More particularly, there is a need to improve performance of liner hanger designs that have failed to achieve adequate axial load holding in an uphole direction when placed in collapse by pressure from downhole.

BRIEF DESCRIPTION OF THE DRAWINGS

These drawings illustrate certain aspects of some of the present disclosure, and should not be used to limit or define the disclosure.

DETAILED DESCRIPTION

The present disclosure relates to a device and method for employing an expandable liner hanger system. More particularly, embodiments of a device and method are disclosed for improving axial load holding by an expandable liner hanger system. An expandable liner hanger may improve axial load holding in an upward direction when placed in collapse by pressure from downhole by avoiding sharp point loads and employing laser transformation hardening as well as stress-relief features.

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention.

The description is provided with reference to a vertical wellbore; however, the embodiments disclosed herein can be used in horizontal, vertical or deviated wellbores.

As used herein, the words "comprise," "have," "include," and all grammatical variations thereof are each intended to have an open, non-limiting meaning that does not exclude additional elements or steps. It should be understood that, as used herein, "first," "second," "third," etc., are arbitrarily assigned, merely differentiate between two or more items, and do not indicate sequence. Furthermore, the use of the term "first" does not require a "second," etc. The terms "uphole," "downhole," and the like, refer to movement or direction closer and farther, respectively, from the wellhead, irrespective of whether used in reference to a vertical, horizontal or deviated borehole.

The terms "upstream" and "downstream" refer to the relative position or direction in relation to fluid flow, again irrespective of the borehole orientation. As used herein, "upward" and "downward" and the like are used to indicate relative position of parts, or relative direction or movement, typically in regard to the orientation of the figures, and does not exclude similar relative position, direction or movement where the orientation in-use differs from the orientation in the figures.

Figure 1:
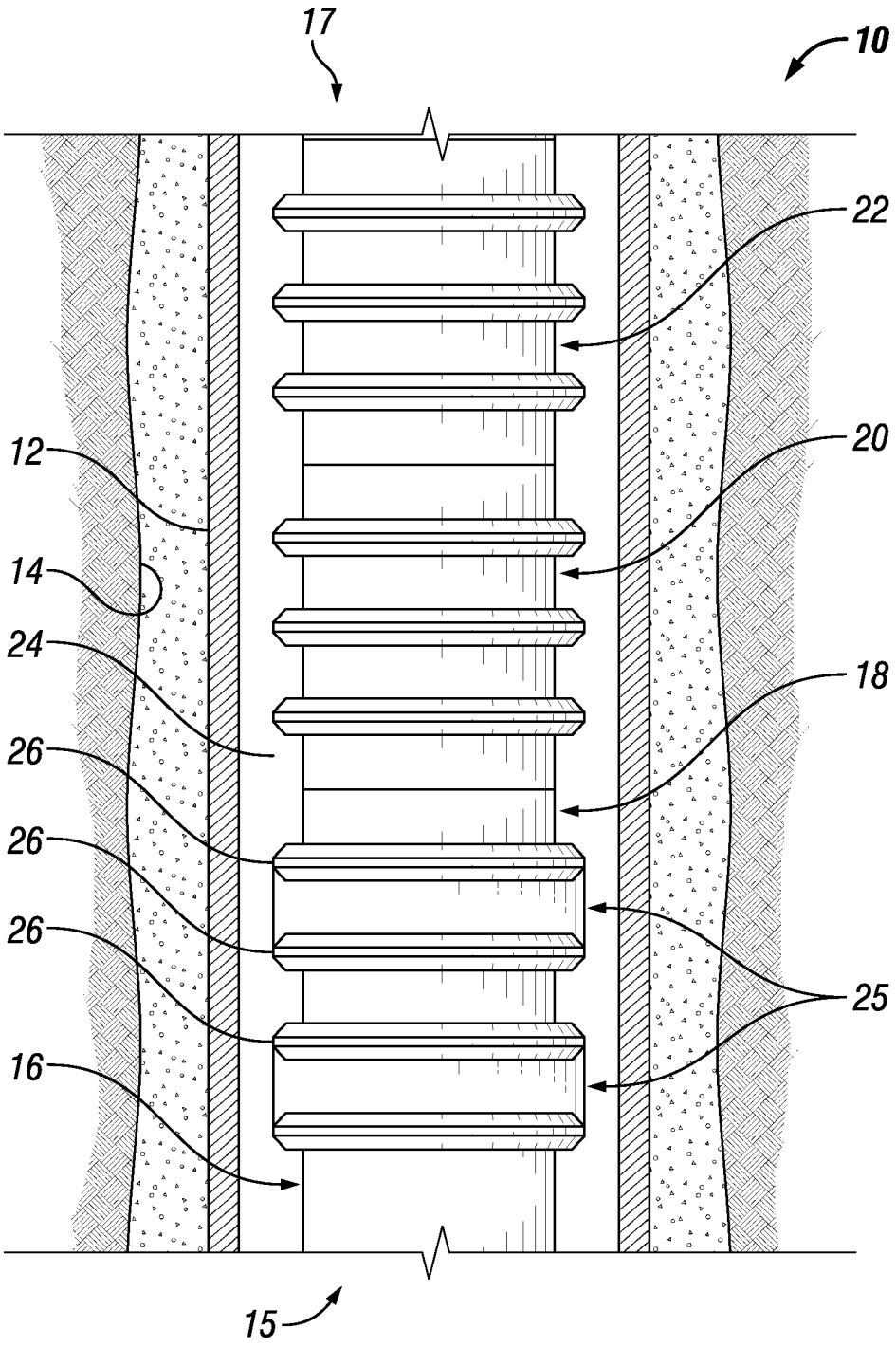
FIG. 1 illustrates an example of an expandable liner hanger system.

FIG. 1 illustrates an example of an expandable liner hanger system 10. In expandable liner hanger system 10, a casing string 12 has been installed and cemented within a wellbore 14. An expandable liner 16 may be hung, extending downhole from a lower end of casing string 12. An annulus 24 may be created between casing string 12 and a work string 22. In embodiments, an expandable liner hanger 18 can support additional wellbore casing, operational tubulars or tubing strings, completion strings, downhole tools, etc., for positioning at greater depths.

As used herein, the terms "liner," "casing," and "tubular" are used generally to describe tubular wellbore items, used for various purposes in wellbore operations. Liners, casings, and tubulars can be made from various materials (metal, plastic, composite, etc.), can be expanded or unexpanded as part of an installation procedure, and can be segmented or continuous. It is not necessary for a liner or casing to be cemented into position. Any type of liner, casing, or tubular may be used in keeping with the principles of the present invention.

As further illustrated in FIG. 1, expandable liner hanger 18 may seal and secure an upper end of expandable liner 16 near a lower end of casing string 12. Alternatively, expandable liner hanger 18 may seal and secure the upper end of expandable liner 16 above a window (not shown) formed through a sidewall of casing string 12, with expandable liner 16 extending outwardly through the window into a branch or lateral wellbore. Thus, it will be appreciated that many different configurations and relative positions of casing string 12 and expandable liner 16 are possible.

In embodiments, as also shown in FIG. 1, a setting tool 20 may be connected proximate expandable liner hanger 18 on work string 22. Work string 22 may convey setting tool 20, expandable liner hanger 18, and expandable liner 16 into wellbore 14, conduct fluid pressure and flow, transmit torque, tensile and compressive force, etc. Setting tool 20 may facilitate conveyance and installation of expandable liner 16 and expandable liner hanger 18, in part by using the torque, tensile and compressive forces, fluid pressure and flow, etc., as delivered by work string 22.

In FIG. 1, expandable liner hanger 18 is illustrated with a plurality of sealing members 25 and a plurality of anchoring ridges 26 positioned on and attached to expandable liner hanger 18. In embodiments, when expandable liner hanger 18 is expanded, such as with an expansion cone, into anchoring and sealing engagement with casing string 12, the plurality of anchoring ridges 26 and the plurality of sealing members 25 engage the interior of casing string 12. These elements are discussed more fully below.

Reliance upon rubber elements for both sealing and anchoring may lead to variation in predicted anchoring values. In high-pressure, high-temperature (HPHT) applications, the sealing ability of a liner hanger may be limited. In operation, it may be difficult to determine how sealing elements and anchoring elements are influencing each other, which complicates the prediction of the performance of a particular design. Several different arrangements may be possible as to the number and axial location with one or more sealing members 25 located at a downhole end 15, and one or more anchoring ridges 26 located at an uphole end 17.

Figure 2:
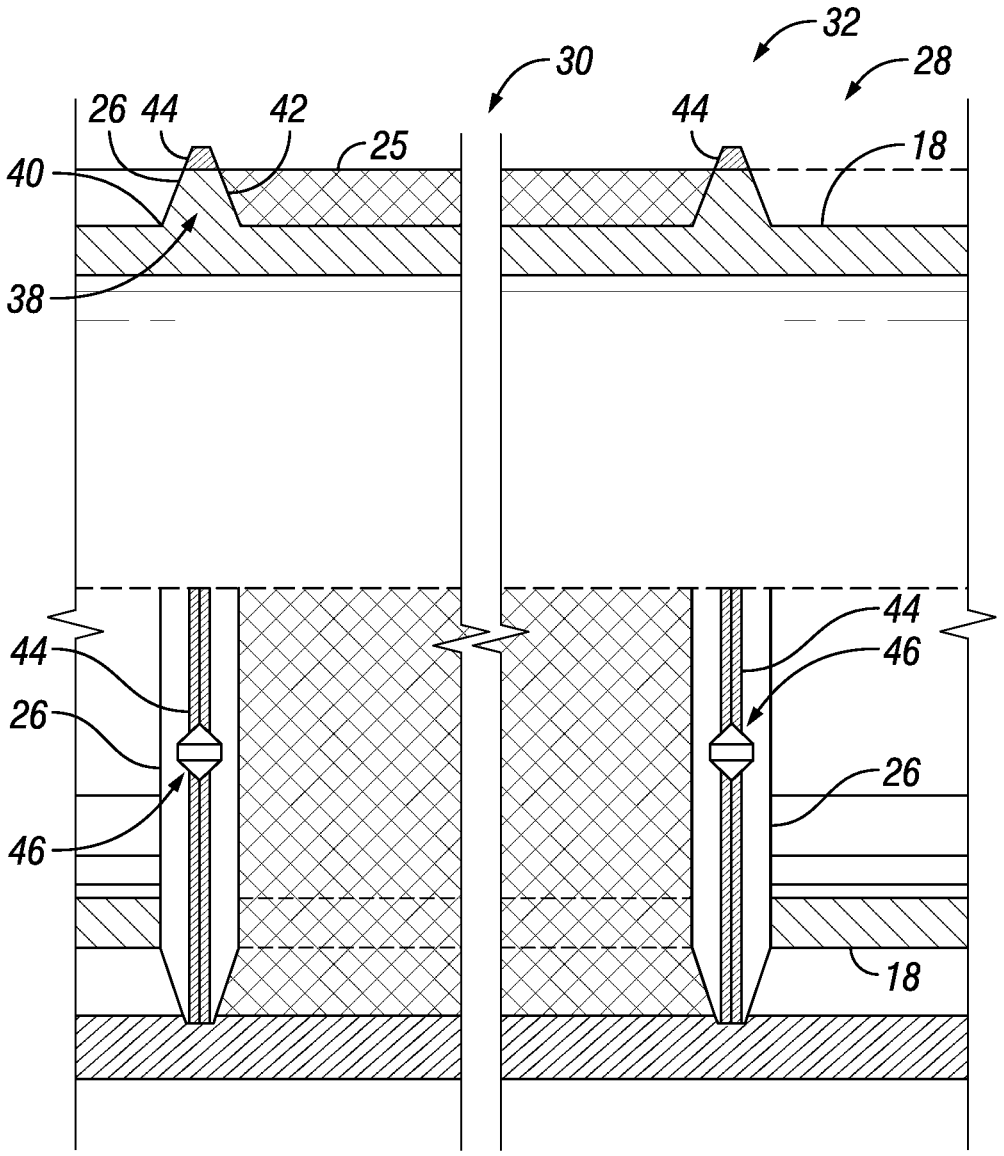
FIG. 2 illustrates an elevational view, with cut-away and partial cross-section, of an example of axial load bearing assembly on expandable liner hanger.

FIG. 2 illustrates an elevational view, with cut-away and partial cross-section, of an embodiment of axial load bearing assembly 28 on expandable liner hanger 18. In embodiments, axial load bearing assembly 28 is shown on expandable liner hanger 18 having a sealing sub-assembly 30 and an anchoring sub-assembly 32. This arrangement may increase axial loading capacity of expandable liner hanger 18. The functions of anchoring and sealing may be performed largely by the separate sub-assemblies.

Sealing sub-assembly 30 may include plurality of sealing members 25, which may be elastomeric, such as a bonded elastomeric material. A plurality of sealing members 25 may be positioned around expandable liner hanger 18. The inner diameters of the plurality of sealing members 25 may abut the outer surface of expandable liner hanger 18. The plurality of sealing members 25 may be spaced longitudinally along expandable liner hanger 18. Alternatively, the plurality of sealing members 25 may be replaced by a single sealing member 25, which may extend longitudinally ranging from about 8 inches (20.3 cm) to about 14 inches (35.5 cm) and, more particularly about twelve inches (30.5 cm), for example. The plurality of sealing members 25 may perform a sealing function, once radially expanded, and provide an annular seal between expandable liner hanger 18 and adjacent casing string 12 (e.g., shown on FIG. 1).

Anchoring sub-assembly 32, as shown in FIG. 2, may be comprised of one or more circumferential, radially extending anchoring ridges 26. One or more anchoring ridges 26 may be circumferentially continuous; however, other arrangements will be apparent to those of skill in the art. As illustrated, each anchoring ridge 26 may comprise a base 38, side walls 40 and 42, and external surface 44.

Figure 3:
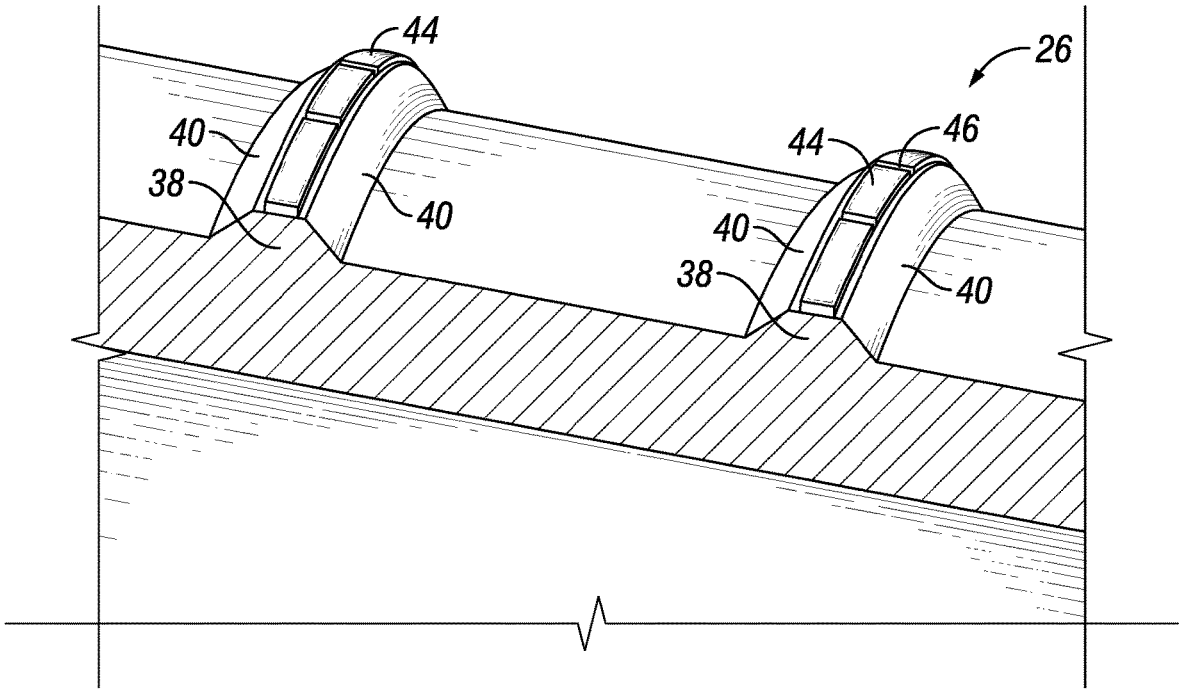
FIG. 3 illustrates a perspective view of an example of an expandable liner hanger assembly 18 with the plurality of anchoring ridges 26.
Figure 5A:
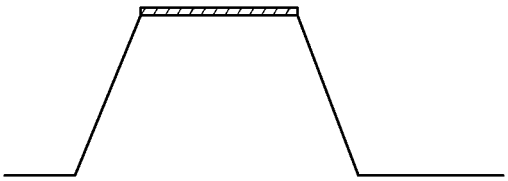
FIG. 5*a*-5*g* illustrate side views of various examples of anchoring ridges.
Figure 5B:
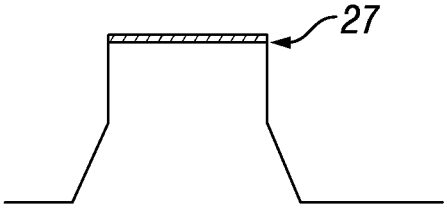
Figure 5C:
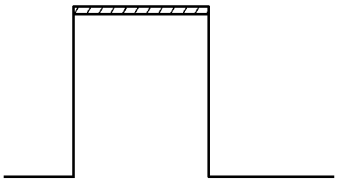
Figure 5D:
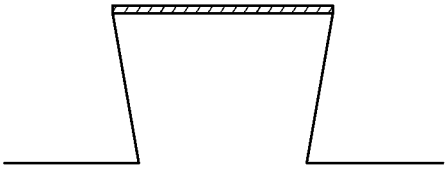
Figure 5E:
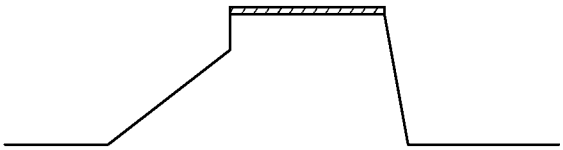
Figure 5F:
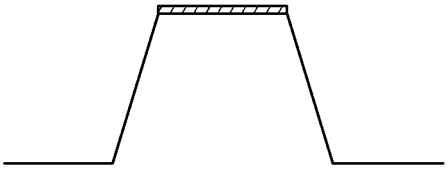
Figure 5G:
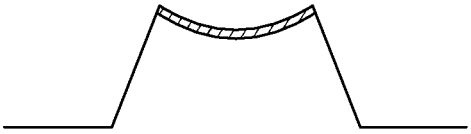

FIG. 3 illustrates a perspective view of expandable liner hanger assembly 18 with the plurality of anchoring ridges 26. As shown in FIGS. 2 and 3, one or more anchoring ridges 26 may be in the shape of a trapezoid. The benefit of providing one or more anchoring ridges 26 with a trapezoidal shape is that it may limit stress risers in casing string 12. A stress riser is a location in an object where stress is concentrated. Further, a "square shoulder" may be provided for one or more anchoring ridges 26 as well as other treatments that can be readily adapted to existing machined circumferential ridge elements. "Square shoulder" is an industry term for any 90-degree corner. More generally, a square shoulder may refer to any 90-degree corner or more obtuse corner that may serve to catch and prevent axial movement. An example of a square shoulder, a square shoulder 27, may be seen in FIG. 5*b*. Thus, FIGS. 2 and 3 illustrate one or more anchoring ridges 26 that may include flat and sharp corners for purposes of preventing movement in a deformed casing string 12 once expanded. This provides a bearing surface thereby decreasing the depth of penetration adverse stress in casing string 12. Further, FIG. 5*a* illustrates a side view of anchoring ridge 26 in the shape of a trapezoid. Alternatively, other shapes and treatments of ridges 26 are illustrated in FIGS. 5*b*-5*g*. These non-point-load configurations for the one or more anchoring ridges 26 should improve axial load holding and decrease the depth of penetration into casing string 12. While certain configurations are disclosed, it should be appreciated that many different variations in ridge design may exist.

External surface 44 of one or more anchoring ridges 26 may be hardened using laser transformation hardening. Laser transformation hardening is an example of a suitable steel surface hardener. Laser transformation hardening produces thin surface zones that are heated and cooled very rapidly, resulting in very fine martensitic microstructures, even in steels with relatively low hardenability. Accordingly, external surface 44 may be of a different hardness than base 38, but external surface 44 may have the same chemical composition as base 38.

Further, the relative hardness of the external surface 44 compared to casing string 12 may be in the HRC 60+ range. HRC is an abbreviation for Rockwell C Hardness. As used herein, Rockwell C Hardness is measured in accordance with ASTM E18-17e1: Standard Test Methods for Rockwell Hardness of Metallic Materials. This feature of hardening external surface 44 may be added to each existing anchoring ridge 26. The depth of the hardness after laser transformation hardening can be controlled by process parameters including power, pulse, and duration. In embodiments, case depths for the external surface 44 of one or more anchoring ridges 26 may be 0.1 to 0.3 inch (0.25 to 0.76 cm). In other embodiments, case depths for the external surface 44 of one or more anchoring ridges 26 may be 0.010 to 0.095 inch (0.025 to 0.24 cm). While a range is not specifically stated, in embodiments a separation of 10 HRC between a hardened anchoring ridge and casing is effective to allow the ridge to anchor in adjacent casing thereby preventing relative movement between the liner hanger and parent casing.

Alternatively, other methods of hardening external surface 44 may be employed. For example, diffusion hardening methods include, but are not limited to, carburizing, nitriding, carbonitriding, nitrocarburizing, boriding, titanium-carbon diffusion, and Toyota diffusion process. However, it may be difficult to selectively apply the diffusion methods without the risk of altering the material of base 38. Further, selective hardening methods include flame hardening, induction hardening, electron beam (EB) hardening, ion implant, selective carburizing and nitriding, and use of arc lamps.

As illustrated in FIG. 2, one or more anchoring ridges 26 may each have a plurality of stress-relief features 46 defined thereon. In embodiments, a stress-relief groove or similar feature may be provided to support plastic expansion. Stress-relief features 46 may be notches or cut-outs spaced circumferentially on one or more anchoring ridges 26, as shown. Further, stress-relief features 46 may be created through milling. Those of skill in the art will recognize other stress-relief features and geometries as well. Stress-relief features 46 may also allow for fluid communication between one or more anchoring ridges 26.

Figure 4A:
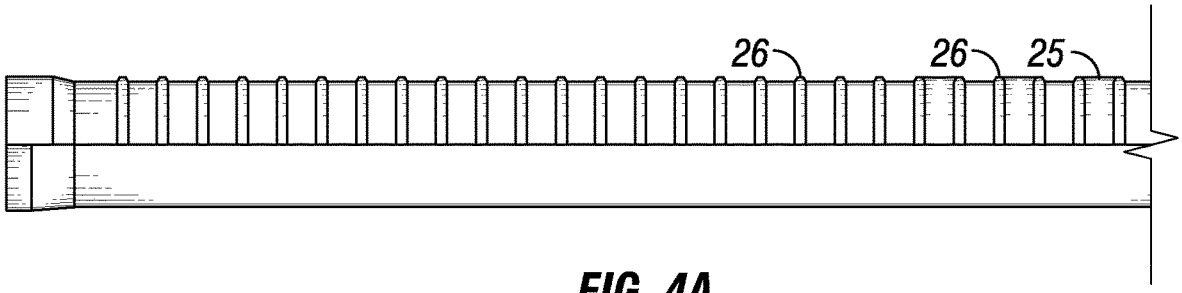
FIG. 4*a* illustrates an example of an expandable liner-hanger assembly with an anchoring sub-assembly and a sealing sub-assembly.
Figure 4B:
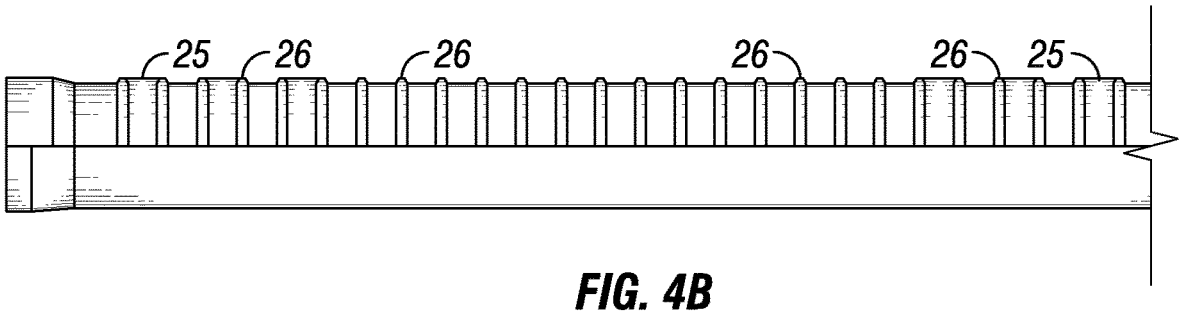
FIG. 4*b* illustrates an example of an expandable liner hanger assembly with an anchoring sub-assembly and two sealing sub-assemblies.

Generally, in the downhole setting, elements with pressure from above (uphole) are typically "boosted" or enhanced because of the pressure on the inner diameter of the liner hanger. Elements with pressure from below (downhole) are typically placed in collapse, thus reducing the contact stress and liner hanger performance when reacting to load from below (downhole). The pressure from below (downhole) may be sealed off by placing one or more sealing members 25 on the bottom of expandable liner hanger 18—thus limiting the influence of collapse pressure—as illustrated in FIG. 4*a*. Further, trapped pressure from expansion of expandable liner hanger 18, which would have a negative influence in the annular space between sealing members 25, may be avoided—thus avoiding decreased performance of one or more anchoring ridges 26. This may be due to fluid being able to communicate through stress-relief features 46 in the one or more anchoring ridges 26. Therefore, stress-relief features 46 may provide stress relief and fluid communication. In another embodiment, as illustrated in FIG. 4*b* another sealing sub-assembly 30 may be placed above the one or more anchoring ridges 26 as well, thereby limiting the ability of pressure to reduce contact stress against casing string 12. In certain scenarios, pressures may be directed from below (downhole) or above (uphole) and/or combined with varying internal pressures—all of which may impact the contact stress that expandable liner hanger 18 has against the inner diameter of casing string 12.

Although the present invention and its advantages have been described in detail, it should be understood that various changes, substitutions and alterations may be made herein without departing from the spirit and scope of the invention as defined by the appended claims.

In embodiments, the following methods are disclosed; the steps are not exclusive and can be combined in various ways. Further, additional steps and limitations are here listed, which can be performed in various order, omitted, or repeated. A method of placing expandable liner hanger 18 having axial load bearing capability, once expanded, in a downhole casing string 12 positioned in a subterranean wellbore, the method comprising the steps of: running-in a radially expandable tool having an anchoring sub-assembly and a sealing sub-assembly; radially expanding the radially expandable tool, thereby engaging the downhole tubular with a plurality of radially extending ridges positioned on the exterior surface of the radially expandable tool by penetrating the downhole tubular with at least one hardened ridge with anchoring corners; engaging the sealing sub-assembly with the downhole tubular and sealing the annulus defined between the expandable tool and downhole tubular; and bearing an axial load placed on the expanded downhole tool.

The method can further comprise steps such as: radially expanding the radially expandable tool using a hydraulically powered expansion cone; and/or wherein the plurality of ridges extend circumferentially around the radially expandable tubular; and/or further comprising at least one radial expansion stress relief feature; and/or wherein the at least one radial expansion stress relief feature comprises at least one longitudinally extending groove defined in at least one ridge. Other steps and orders of steps are apparent to one of skill in the art. Those of skill in the art will recognize additional steps, different order of steps, and that not all steps need be performed to practice the inventive methods described.

Accordingly, this disclosure describes systems, devices, and methods for employing an expandable liner hanger system. Without limitation, the systems, devices, and methods may include any of the following statements:

Statement 1: A radially expandable downhole tool for bearing axial loads upon radial expansion into anchoring and sealing engagement with a downhole tubular positioned in a subterranean wellbore, the tool comprising: a radially expandable tubular defining an interior passageway and an exterior surface; and an axial load bearing assembly positioned on the exterior surface of the radially expandable tubular and comprising: an anchoring sub-assembly for, after the radial expansion, engaging the downhole tubular and bearing axial loads placed on the downhole tool, the anchoring sub-assembly comprising a plurality of ridges that extend radially, each of the plurality of ridges comprising a hardened anchoring surface and corners, for penetrating into the downhole tubular and a plurality of longitudinally extending milled grooves formed in each of the plurality of ridges; and a sealing sub-assembly for, after the radial expansion, engaging the downhole tubular and sealing the annulus defined between the downhole tubular and the radially expandable downhole tool.

Statement 2: The tool of statement 1, wherein the hardened anchoring surface is hardened by laser transformation hardening.

Statement 3: The tool of statements 1 or 2, wherein the anchoring surface is hardened to a depth ranging from about 0.1 to about 0.3 inch.

Statement 4: The tool of any one of statements 1 to 3, wherein each of the plurality of ridges extends circumferentially around the radially expandable tubular.

Statement 5: The tool of any one of statements 1 to 4, wherein the sealing sub-assembly is located downhole of the anchoring sub-assembly on the axial load bearing assembly.

Statement 6: The tool of any one of statements 1 to 5, wherein more than one of the sealing sub-assembly is located on both sides of the anchoring sub-assembly on the axial load bearing assembly.

Statement 7: The tool of any one of statements 1 to 6, wherein at least one of the plurality of ridges has a trapezoidal shape.

Statement 8: The tool of any one of statements 1 to 7, wherein at least one of the plurality of ridges has a non-symmetric shape.

Statement 9: The tool of any one of statements 1 to 8, wherein at least one of the plurality of ridges has a non-symmetric, radiused external surface.

Statement 10: The tool of any one of statements 1 to 8, wherein the sealing member extends longitudinally for a range between about 8 inches to about 14 inches.

Statement 11: A method of placing a radially expandable tool having axial load bearing capability, once expanded, in a downhole tubular positioned in a subterranean wellbore, the method comprising the steps of: running-in a radially expandable tool into the subterranean wellbore, wherein the radially expandable tool comprises an anchoring sub-assembly and a sealing sub-assembly; radially expanding the radially expandable tool, thereby engaging the downhole tubular with a plurality of radially extending hardened ridges positioned on the exterior surface of the radially expandable tool by penetrating the downhole tubular, wherein a plurality of longitudinally extending grooves are milled in each of the plurality of the ridges; engaging the sealing sub-assembly with the downhole tubular to seal an annulus defined between the expandable tool and downhole tubular; and bearing an axial load placed on the expanded downhole tool.

Statement 12: The method of statement 11, wherein the radially expanding step further comprises radially expanding the radially expandable tool using a hydraulically powered expansion cone.

Statement 13: The method of statements 11 or 12, wherein the sealing sub-assembly further comprises at least one annular sealing member, each annular sealing member being circumferentially bounded by ridges.

Statement 14: The method of any of the preceding statements, wherein each of the plurality of ridges is hardened by laser transformation hardening.

Statement 15: The method of any of the preceding statements, wherein each of the plurality of ridges is hardened to a depth ranging from about 0.1 to about 0.3 inch.

Statement 16: The method of any of the preceding statements, wherein each of the plurality of ridges extends circumferentially around the radially expandable tubular.

Statement 17: The method of any of the preceding statements, wherein at least one of the plurality of ridges has a trapezoidal shape.

Statement 18: The method of any of the preceding statements, wherein at least one of the plurality of ridges has a nonsymmetric shape.

Statement 19: The method of any of the preceding statements, wherein at least one of the plurality of ridges has a nonsymmetric, radiused external surface.

Statement 20: The method of any of the preceding statements, wherein the sealing sub-assembly is located downhole of the anchoring sub-assembly on the axial load bearing assembly.

Persons of skill in the art will recognize various combinations and orders of the above described steps and details of the methods presented herein. While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A radially expandable downhole tool for bearing axial loads upon radial expansion into anchoring and sealing engagement with a downhole tubular positioned in a subterranean wellbore, the tool comprising:

a radially expandable tubular defining an interior passageway and an exterior surface; and an axial load bearing assembly positioned on the exterior surface of the radially expandable tubular and comprising:

an anchoring sub-assembly operable to engage the downhole tubular and bear axial loads placed on the downhole tool, the anchoring sub-assembly comprising a plurality of ridges that extend radially, wherein a ridge comprises five sides, wherein a distal side comprises a hardened anchoring surface, wherein the ridge is continuous and extends lengthwise along an entire circumference of the downhole tool; and a sealing sub-assembly for, after the radial expansion, engaging the downhole tubular and sealing the annulus defined between the downhole tubular and the radially expandable downhole tool.

2. The tool of claim 1, wherein the hardened anchoring surface is hardened by laser transformation hardening.

3. The tool of claim 2, wherein the hardened anchoring surface is hardened to a depth ranging from 0.1 to 0.3 inch.

4. The tool of claim 1, wherein portions of the ridge extend lengthwise in an end-to-end configuration, wherein cutouts of the ridge extend in a direction of a longitudinal axis of the downhole tool.

5. The tool of claim 1, wherein the sealing sub-assembly is located downhole of the anchoring sub-assembly on the axial load bearing assembly.

6. The tool of claim 1, wherein more than one of the sealing sub-assembly is located on both sides of the anchoring sub-assembly on the axial load bearing assembly.

7. The tool of claim 1, wherein at least one of the plurality of ridges has a trapezoidal shape.

8. The tool of claim 1, wherein at least one of the plurality of ridges has a nonsymmetric shape.

9. The tool of claim 1, each ridge further comprising a base, wherein a hardness of the hardened anchoring surface is different than a hardness of the base, wherein the hardened anchoring surface and the base have the same chemical composition.

10. The tool of claim 1, wherein the sealing sub-assembly extends longitudinally for a range between 8 inches to 14 inches.

11. A method of placing a radially expandable tool having axial load bearing capability, once expanded, in a downhole tubular positioned in a subterranean wellbore, the method comprising the steps of:

running-in a radially expandable tool into the subterranean wellbore, wherein the radially expandable tool comprises an anchoring sub-assembly and a sealing sub-assembly;

radially expanding the radially expandable tool, thereby engaging the downhole tubular with a plurality of radially extending hardened ridges positioned on an exterior surface of the radially expandable tool by penetrating the downhole tubular, wherein a radially extending hardened ridge comprises five sides, wherein a distal side comprises a hardened anchoring surface, wherein the radially extending hardened ridge is continuous and extends lengthwise along an entire circumference of the radially expandable tool;

engaging the sealing sub-assembly with the downhole tubular to seal an annulus defined between the expandable tool and downhole tubular; and bearing an axial load placed on the expanded downhole tool.

12. The method of claim 11, wherein the radially expanding step further comprises radially expanding the radially expandable tool using a hydraulically powered expansion cone.

13. The method of claim 11, wherein the sealing sub-assembly further comprises at least one annular sealing member, each annular sealing member being circumferentially bounded by one or more of the hardened ridges.

14. The method of claim 11, wherein each of the plurality of hardened ridges is hardened by laser transformation hardening.

15. The method of claim 14, wherein each of the plurality of hardened ridges is hardened to a depth ranging from 0.1 to 0.3 inch.

16. The method of claim 11, wherein portions of the radially extending hardened ridge extend lengthwise in an end-to-end configuration, wherein cutouts of the radially extending hardened ridge extend in a direction of a longitudinal axis of the radially expandable tool.

17. The method of claim 11, wherein at least one of the plurality of hardened ridges has a trapezoidal shape.

18. The method of claim 11, wherein at least one of the plurality of hardened ridges has a nonsymmetric shape.

19. The method of claim 11, wherein each of the radially extending hardened ridges comprises a base and a hardened anchoring surface, wherein a hardness of the hardened anchoring surface is different than a hardness of the base, wherein the hardened anchoring surface and the base have the same chemical composition.

20. The method of claim 11, wherein the sealing sub-assembly is located downhole of the anchoring sub-assembly on the axial load bearing assembly.

* * * * *